United States Patent [19]

Inghirami

[11] Patent Number: 5,036,560

[45] Date of Patent: Aug. 6, 1991

[54] METHOD OF IRONING ARTICLES OF CLOTHING AND APPARATUS FOR CARRYING OUT THE METHOD

[75] Inventor: Fabio Inghirami, San Sepolcro, Italy

[73] Assignee: Reggiani Tessilr S.P.A., Milan, Italy

[21] Appl. No.: 457,765

[22] PCT Filed: May 25, 1988

[86] PCT No.: PCT/IT88/00040

§ 371 Date: Nov. 29, 1989

§ 102(e) Date: Nov. 29, 1989

[87] PCT Pub. No.: WO88/09839

PCT Pub. Date: Dec. 15, 1988

[30] Foreign Application Priority Data

Jun. 4, 1987 [IT] Italy ..... 29784 A/87

[51] Int. Cl.[5] ..... D06B 3/30

[52] U.S. Cl. ..... 8/149.1; 8/149.2; 34/233; 68/5 D; 68/9; 68/20

[58] Field of Search ..... 8/149.1, 149.2, 149.3; 68/5 C, 5 D, 5 E, 9, 20; 223/70, 73; 34/210, 212, 232, 233

[56] References Cited

U.S. PATENT DOCUMENTS

| | | | |
|---|---|---|---|
| 3,352,627 | 11/1967 | Indreland | 8/144.2 X |
| 3,644,085 | 2/1972 | Beeley et al. | 68/5 C X |
| 3,696,523 | 10/1972 | Beeley et al. | 68/5 C X |
| 3,738,019 | 6/1973 | Forg et al. | 8/149.2 X |
| 3,765,580 | 10/1973 | Wilsker et al. | 68/5 D X |
| 3,849,815 | 11/1974 | Frauendorf | 68/5 C X |
| 4,403,425 | 9/1983 | Mussiger | 68/5 C X |

FOREIGN PATENT DOCUMENTS

| | | | |
|---|---|---|---|
| 370790 | 5/1983 | Austria . | |
| 3119664 | 12/1982 | Fed. Rep. of Germany . | |
| 3119618 | 1/1983 | Fed. Rep. of Germany . | |
| 3600953 | 7/1987 | Fed. Rep. of Germany . | |
| 1401503 | 7/1975 | United Kingdom | 68/5 C |
| 2060725 | 5/1981 | United Kingdom . | |

*Primary Examiner*—Philip R. Coe

*Attorney, Agent, or Firm*—Michael J. Striker

[57] ABSTRACT

A method of ironing articles of clothing suspended on hangers includes the step of directing opposite hot air jets onto two large sides of a moving previously wetted article with the opposite hot air jets acting to impinge upon the treated article in a direction from top to bottom so as to maintain the article in a state of vertical tension during the treatment, and the hot air being directed symmetrically onto the two sides of the moving articles through a plurality of superimposed nozzles which are inclined downwardly about 45° to a plane of movement of the article. An apparatus for implementing the method is also disclosed.

14 Claims, 5 Drawing Sheets

METHOD OF IRONING ARTICLES OF CLOTHING AND APPARATUS FOR CARRYING OUT THE METHOD

BACKGROUND OF THE INVENITON

This invention relates to a method of ironing articles of clothing, such as jackets, shirts, overcoats and the like, preferably by continuous operation, and to an apparatus for carrying out the method, wherein hot air jets are directed symmetrically from top to bottom onto both sides of the articles through a plurality of superimposed nozzles which are inclined downwardly about 45° to the plane of movement of the articles.

Ironing of articles of clothing, in particular those made of an industrial scale, is at present performed by pressing operation, more specifically by means of two opposite conveniently heated plates which are closed on the article while suspended on a hanger, put on a dummy, or lying in spread condition. This method has a number of disadvantages.

In a first place, the two opposite plates can usually only iron the front and back of a garment, whereas it is desirable that the sleeves thereof should be ironed separately.

Moreover, the article of clothing has to be put with care on its support in order to prevent formation of folds which may cause creases to appear on the ironed articles after pressing.

These ironing machines are, obviously, of a discontinuous-operation type, in that a single article is fed at a time between the opposite press plates, so that their working rate is rather low.

SUMMARY OF THE INVENTION

From AT-A-370790 an apparatus is known by which a method of ironing articles of clothing is carried out, wherein opposite hot air jets are directed onto the two larger sides of the articles which are suspended on hangers and which have been previously wetted.

The opposite air jets act to impinge upon the article in a direction from top to bottom so as to maintain the article in a state of vertical tension during the treatment.

The object of this invention is a method and an apparatus to ensure through ironing of an entire article of clothing by a very rapid process.

This object is acheived according to the invention which provides a method of ironing articles of clothing by means of hot air jets which are directed from top to bottom towards the treated article so as to evenly impinge upon it, thereby to keep the article in a stretched state on its hanger or any other support means on which it is suspended, said air jets are being directed so towards the two opposite sides of a previously wetted article as to be inclined through substantially 45° to the plane of said article. At the end of the ironing operation, the article is cooled by means of cool air jets that are oriented in the same direction as the preceding hot air jets.

The process is, with preference, carried out continuously, that is with the articles being moved on a constant speed during the treatment.

The apparatus for carrying the method into effect is, preferably, one of a linear type and is comprised of modular sections each having a centrally disposed tunnel through which the articles suspended on corresponding hangers carried on a conveyor chain, are fed.

In a first of said sections the articles are wetted by means of an air-water atomizing system comprising a series of adjustable atomizing heads arranged on both longitudinal sides of this section.

Following said wetting section is a drying-ironing section comprising an array of radial fans which draw in hot air and discharge the hot air symmetrically towards the two sides of the articles moving in the section, through downwardly oriented nozzles that are included about 45° to the plane of movement of the articles.

In this way, the hot air jets impinging in an evenly distributed manner upon a garment, in addition to drying it, also achieve thorough ironing thereof due to the tension exerted from top to bottom upon the article by said hot air jets.

Provided at the ironing section is an exhausing conduit for removing moisture and charging air.

Finally, a cooling-stabilizing section is provided and has, in turn, fans that are arranged to direct on the ironed articles cool air drawn in from the outside.

BRIEF DESCRIPTION OF THE DRAWINGS

Further features of the invention will be better understood when reading the following detailed description of one embodiment thereof shown, by way of example only, in the accompanying drawings, wherein.

DETAILED DESCRIPTION OF PREFERRED EMBODIMENTS

Referring now to the above figures and, more specifically, to FIG. 1, an apparatus, or more particularly, a line for ironing articles of clothing according to the invention will be described herein after.

This ironing line is composed of three distinct sections: an initial wetting and preparing section 1, an intermediate drying and ironing section 2 and a terminal cooling and stabilizing station 3 for the articles of clothing to be treated.

The different sections consist of modular blocks 4 making for an easy construction and assembling of the line.

Figure 1:
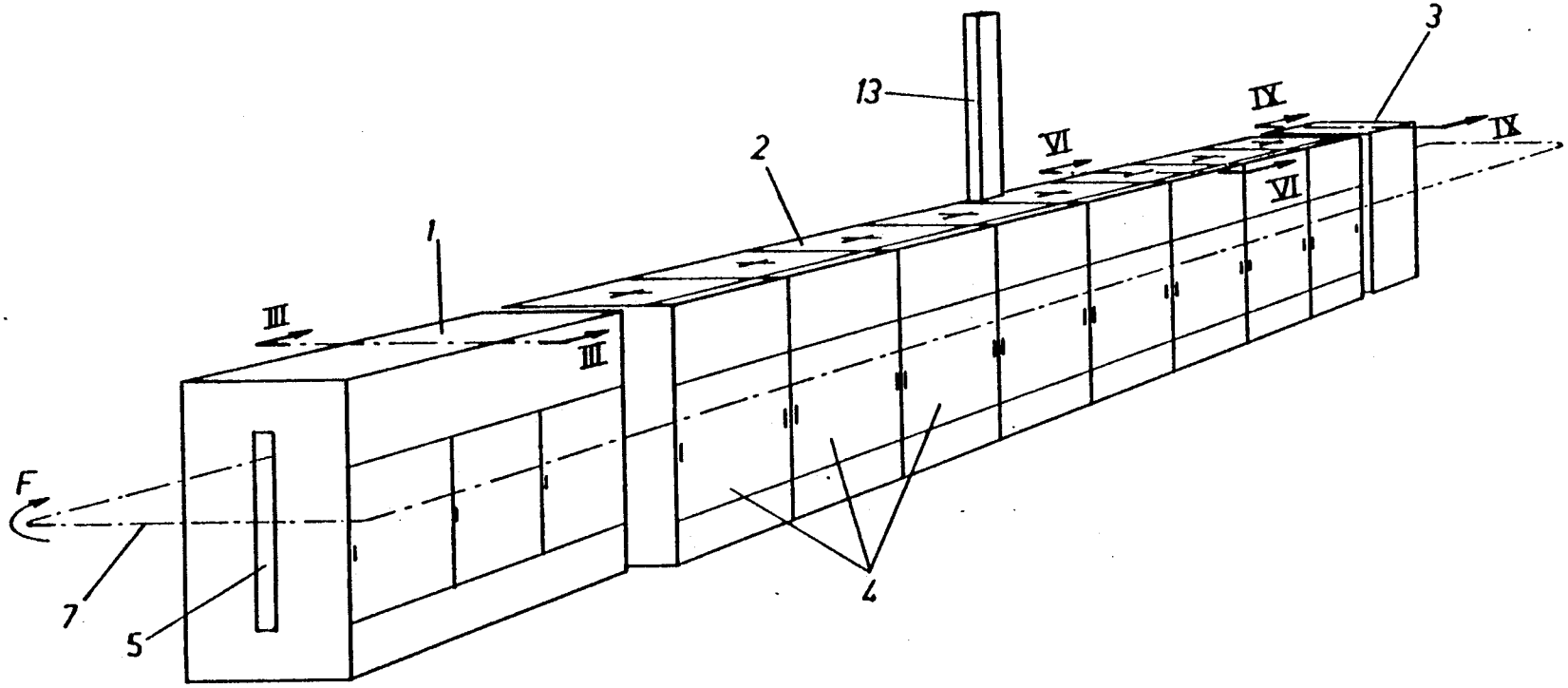
FIG. 1 is a schematic perspective view of an ironing line using the method according to the invention.

Centrally provided in each section in a tunnel 5 for permitting continuous supply therethrough of the articles to be treated, which articles are suspended on respective hangers 6 carried by an endless conveyor chain 7 moved at constant speed in the direction of arrow F (FIG. 1).

While the ironing apparatus according to the invention is shown to be of a linear type in the accompanying drawings, it is to be understood that it could take other configurations, when viewed in plan, and, for example, a circular configuration.

The articles of clothing to be treated are moved through the tunnel 5 with the large part thereof being oriented in the direction of the tunnel axis.

Figure 3:
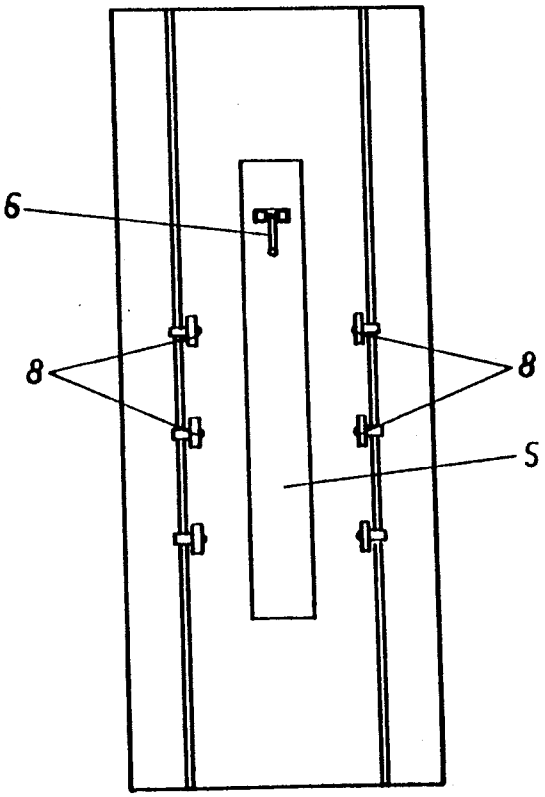
FIG. 3 is a schematic cross-sectional view of the section in FIG. 2 taken on the line III—III in FIG. 1.
Figure 2:
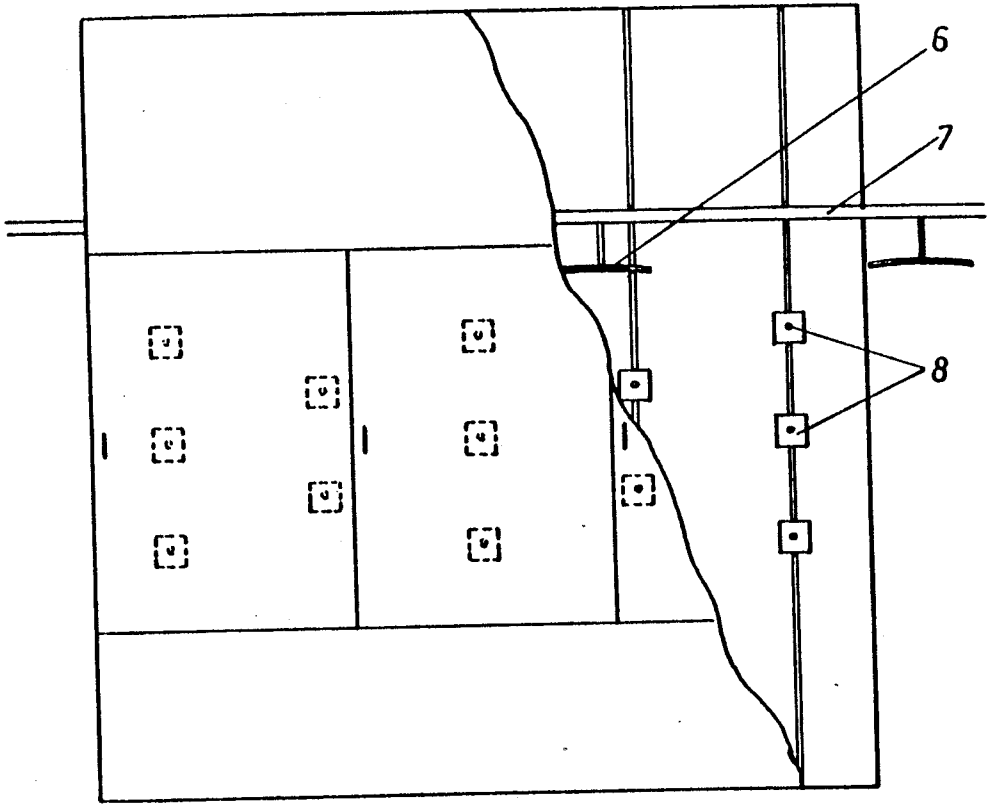
FIG. 2 is a longitudinal, part cutaway view showing the initial wetting section of the ironing line in FIG. 1.
Figure 4:
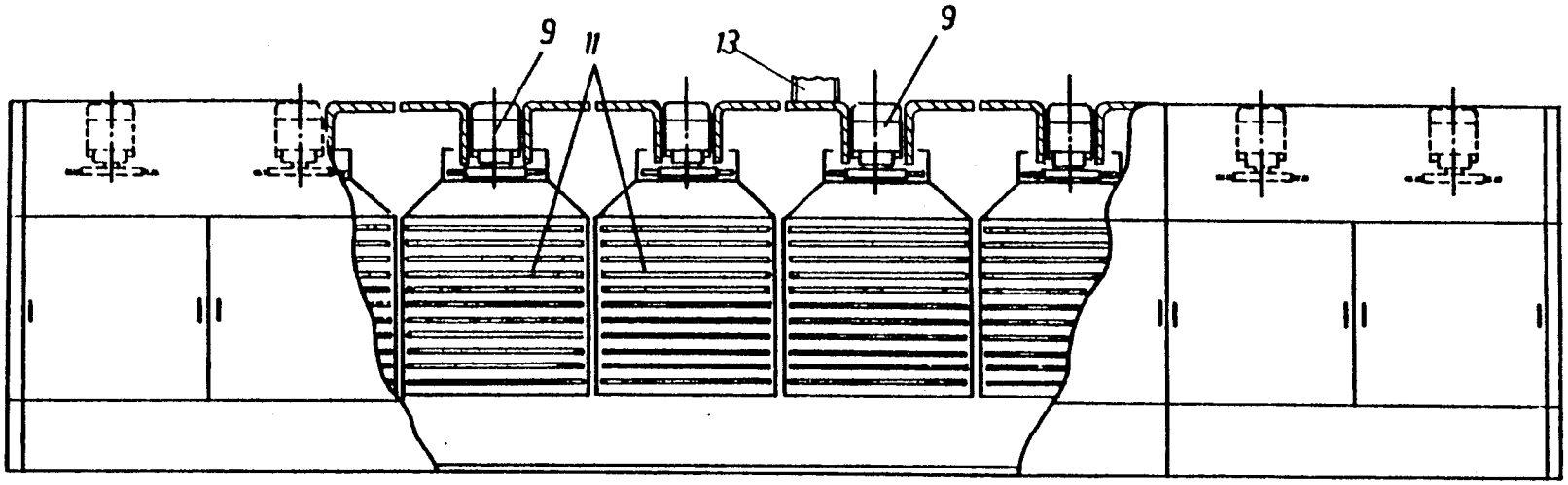
FIGS. 4 and 5 are a longitudinal, part cutaway view and a top plan view, respectively, on the central drying-ironing section of the ironing line in FIG. 1.
Figure 5:
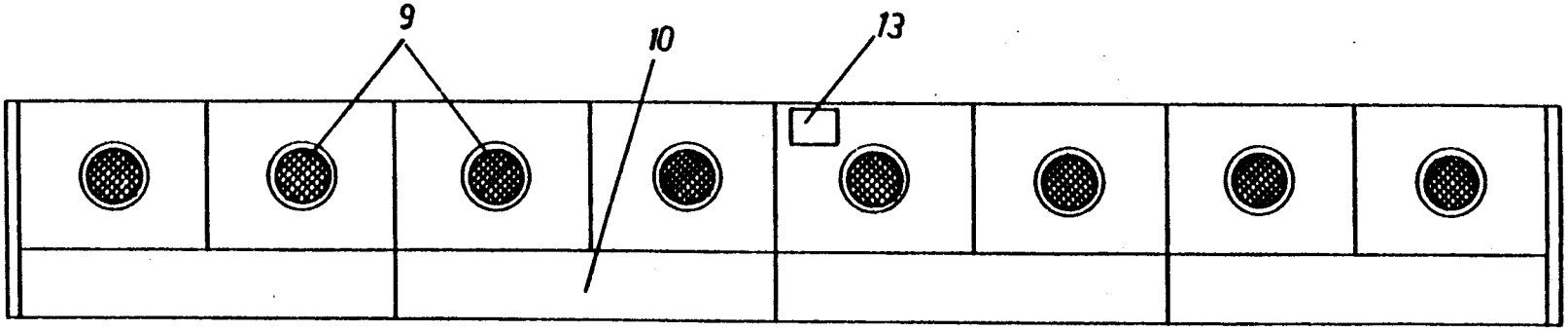

In the initial wetting section 1, the articles are wetted and prepared for the next ironing step by means of an air-water atomizing system comprised of a series of adjustable atomizing heads 8 (see FIGS. 2 and 3) arranged along the two opposite longitudinal sides of section 1.

The thus wetted articles attain the drying-ironing section 2 which includes a series of radial fans 9 disposed with their axis in a vertical direction in the upper part of section 2. Each fan 9 acts to draw in hot air—which has been previously heated by known means—from a tank 10 mounted on a wall inside the section 2, and to discharge the drawn hot air into a pair of oppositely arranged hollow bulkheads 11 which, in turn, direct said hot air onto the articles that are moving therebetween.

Figure 7:
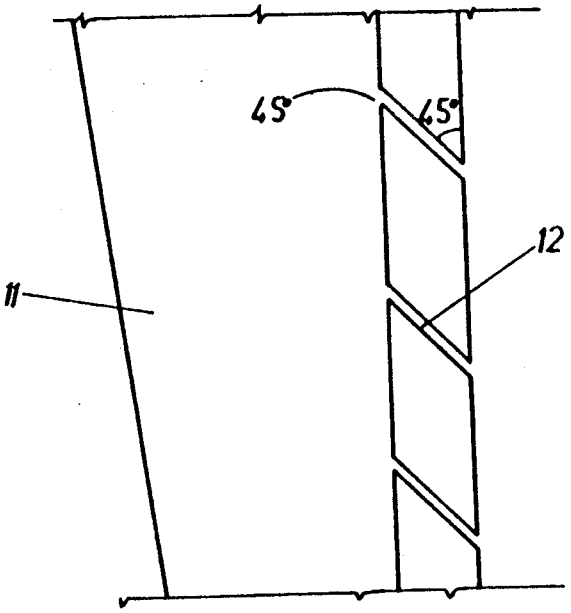
FIG. 7 shows, on a larger scale, the detail designated at A in FIG. 6.
Figure 6:
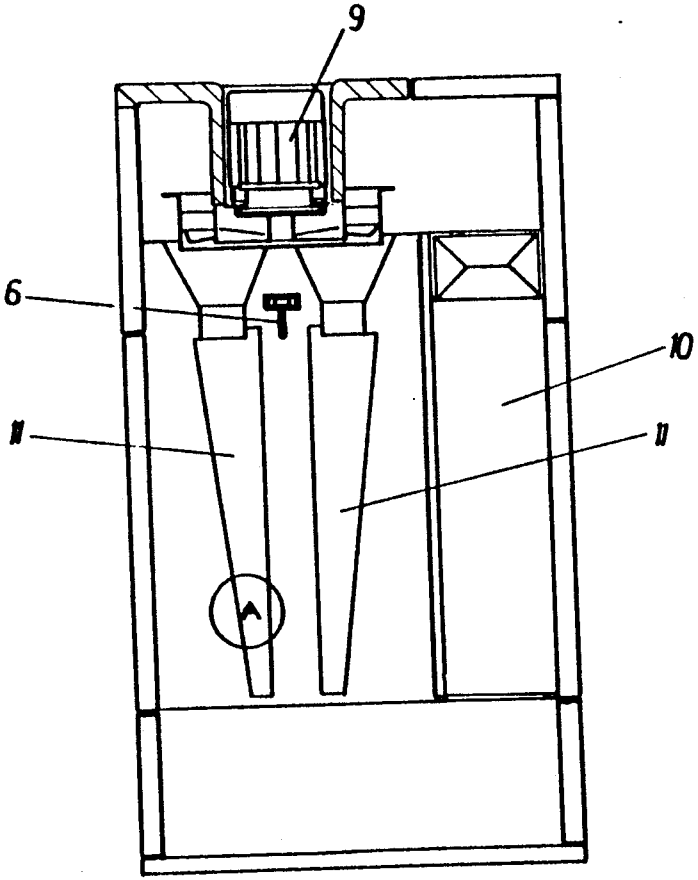
FIG. 6 is a cross-sectional view of the ironing section in FIGS. 4 and 5, taken along VI—VI in FIG. 1.
Figure 9:
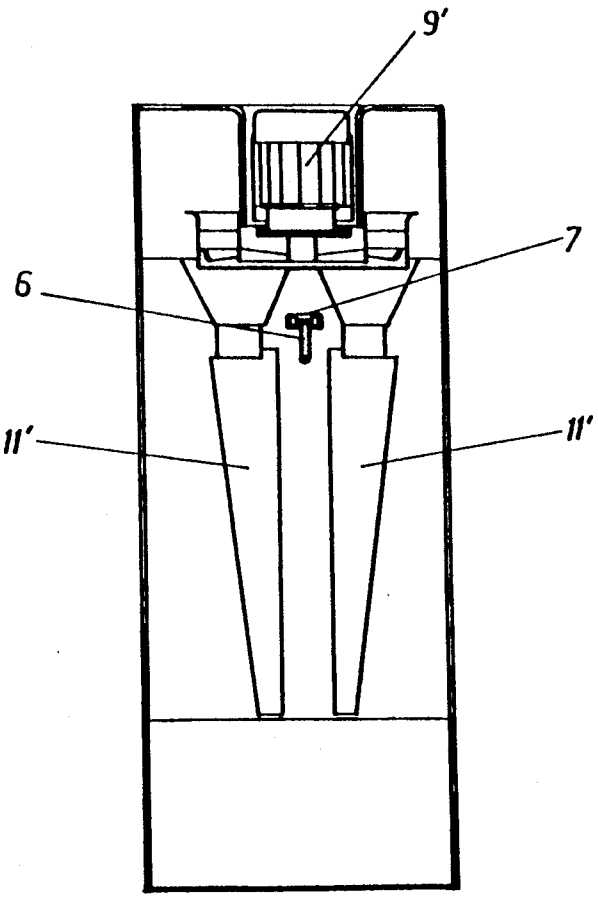
FIG. 9 is a cross-sectioanl view of the cooling section in FIG. 8 taken on the line IX—IX in FIG. 1.
Figure 8:
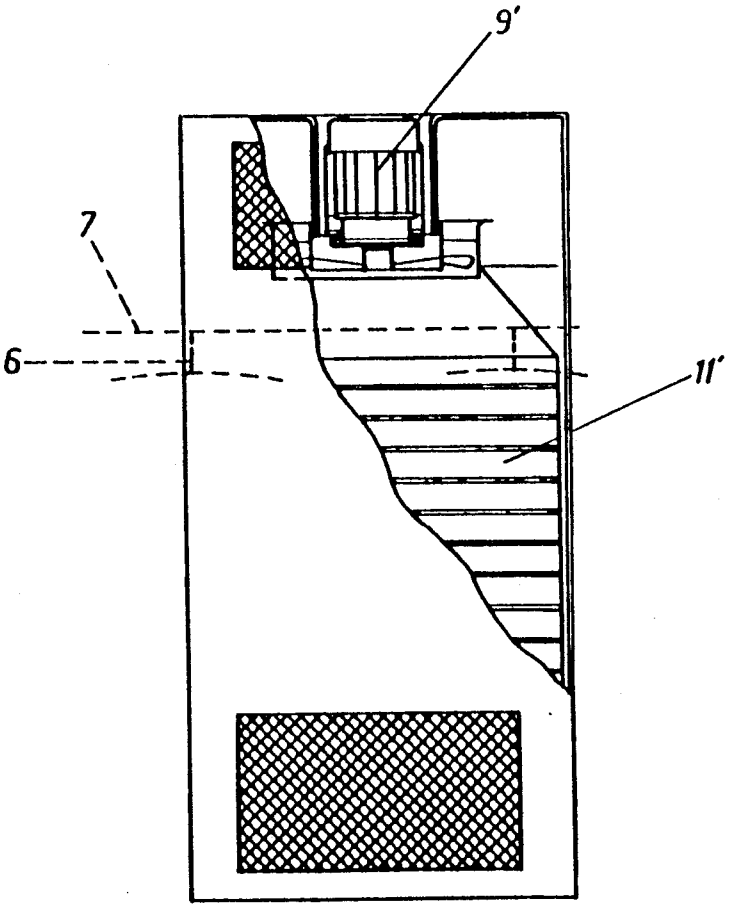
FIG. 8 is a longitudinal part cut-away view showing the terminal cooling section of the ironing line in FIG. 1.

In particular, the hollow bulkheads 11 are provided with air discharging, uniformly distributed nozzles 12 (FIG. 7) which are arranged to direct a respective hot air jet onto an article to be treated in a direction from top to bottom which is preferably inclined about 45° to the moving plane of the articles.

Thus, an article to be treated is subjected to a downwardly directed tension by the opposite hot air jets from nozzles 12 thereby to be thoroughly ironed while being dried.

By this ironing method, which has proven very effective, the risk of any crease being formed on the treated article, even when this should be put carelessly on its hanger 6, is entirely avoided due to the fact that no pressing action is involved.

Also provided in the ironing section 2 is an exhausing stack 13 for removal of moisture and change of air.

The thus ironed articles will then pass to the final cooling-stabilizing section 3 where at least one radial fan 9' is provided to draw in cool air from the outside and to discharge it through opposite hollow bulkheads 11', and associated nozzles, towards the article being treated.

The cool air jets in cooling section 3 impinge upon the articles in the same way as do the hot air jets in dry-ironing section 2.

Some dimensioning valves for the machine according to this invention are given below by way of example only.

By assuming a chosen working speed of 12.5 meters per minute and a spaced relation between the articles to be treated of 1.25 meters, there will be obtained 10 treated articles per minute or 600 per hour, which is a rather high rate.

The time the articles remain in the wetting-preparing section 1 is 15 sec. so that this section will be 3 m long.

The time the articles will spend in the drying-ironing section 2 is 60 sec. which corresponds to this section 2 being 12 m long. The temperature in the ironing section 2 is held at about 100°-120°. The radial fans 9 is this section 2 have a volume delivery of 18,000 $m^3/h$ and a head of 90 mm $H_2O$. In order to change air in this section, a centrifugal fan is provided which has a volume delivery of 9,000 $m^3/h$ and a head of 150 mm $H_2O$.

Finally, the time during which the articles remain in the terminal cooling-stabilizing section 3 is 7.2 sec., so that this section 3 will be 1.5 m long.

By having the three sections spaced 0.5 mm apart, the whole length of the ironing line according to this invention will be 17.5 m.

Moreover, during the process a disinfectant may be used, for example, in admixture with the water to be sprayed on the articles in the wetting section 1, or with the hot air to be directed onto the articles in the ironing station 2, thereby to have the articles sterilized while being treated.

It should be apparent that the invention is not restricted to the particular embodiment that has been described herein before and shown in the accompanying drawings, and many changes as to the construction details may be made thereto without departing from the spirit and scope of the invention.

I cliam:

1. A method of ironing articles of clothing suspended on hangers (6), said method comprising the step of directing opposite hot air jets onto two large sides of a moving previously wetted article, the opposite hot air jets acting to impinge upon the treated article in a direction from top to bottom so as to maintain the article in a state of vertical tension during the treatment, hot air being directed symmetrically onto the two sides of the article through a plurality of superimposed nozzles which are inclined downwardly about 45° to a plane of movement of the article.

2. The method according to claim 1, wherein the article is moving at constant speed during the treatment.

3. The method according to claim 1, wherein a disinfectant is used during the treatment in order to sterilize the article.

4. The method according to claim 1, further including the step of cooling the ironed article by opposite cool air jets directed from top to bottom on to the article.

5. The method according to claim 4, wherein the cool air jets are directed at an angle of about 45° to the plane of movement of the article.

6. An apparatus for ironing articles of clothing suspended on respective hangers carried by a conveyor chain moving through a tunnel (5) with a large part thereof being oriented in a direction of an axis of the tunnel, said apparatus comprising an initial wetting section; an intermediate drying-ironing section; and a terminal cooling-stabilizing section; the intermediate ironing section (2) having means for directing opposite hot air jets from top to bottom onto two large sides of the articles, said opposite hot air jets acting to maintain the articles in a state of vertical tension, said hot air jets directing means comprising a plurality of radial fans disposed with their axis in a vertical direction at a top of the intermediate section, each radial fan drawing in hot air from a tank mounted inside said intermediate section, and each fan discharging the hot air into a pair of opposite hollow bulkheads directing hot air symmetrically onto the two sides of an article to the treated via discharging nozzles whose axes are inclined about 45° to a plane of movement of the articles.

7. The apparatus according to claim 6, wherein an exhaust pipe is provided in said intermediate section for enabling the air in said intermediate section to be changed by a centrifugal fan.

8. The apparatus according to claim 6, wherein said wetting section has an air-water atomizing system comprising an array of adjustable atomizing heads arranged on both longitudinal sides of said wetting section.

9. The apparatus according to claim 6, wherein said terminal cooling section comprises at least one fan which draws in cool air from surrounding atmosphere and discharges the drawn cool air into a pair of opposite hollow bulkheads which direct the cool air evenly from top to bottom onto the ironed articles.

10. The apparatus according to claim 6, wherein said conveyor chain is driven at a constant speed to feed the articles continuously at the constant speed in the tunnel which centrally extends through said initial, intermediate and terminal sections.

11. The apparatus according to claim 10, wherein the constant speed at which the conveyor chain is moved corresponds to a working speed of apparatus and is 12.5 meters per minute, time an article spends in said wetting section is 15 sec., in said intermediate section is 60 sec., in said cooling section is 7.5 sec.

12. The apparatus according to claim 11, wherein a temperature in said intermediate section is maintained at about 100°–120° C., said radial fans having a capacity of 18,000 $m^3/h$ and a head of 90 m $H_2O$.

13. The apparatus according to claim 6, having one of linear and circular configuration in plan view.

14. The apparatus according to claim 6, wherein said initial, intermediate, and terminal sections are comprised of modular blocks.

* * * * *